US010455658B2

(12) United States Patent
Wray

(10) Patent No.: US 10,455,658 B2
(45) Date of Patent: Oct. 22, 2019

(54) MULTI-MODE LIGHTING SYSTEM AND METHOD

(71) Applicant: Donald L. Wray, Ocala, FL (US)

(72) Inventor: Donald L. Wray, Ocala, FL (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 16/110,690

(22) Filed: Aug. 23, 2018

(65) Prior Publication Data

US 2019/0069367 A1 Feb. 28, 2019

Related U.S. Application Data

(60) Provisional application No. 62/549,191, filed on Aug. 23, 2017.

(51) Int. Cl.
*H05B 33/08* (2006.01)
*H05B 37/02* (2006.01)

(52) U.S. Cl.
CPC ..... *H05B 33/0848* (2013.01); *H05B 33/0815* (2013.01); *H05B 33/0845* (2013.01); *H05B 33/0857* (2013.01); *H05B 37/0245* (2013.01)

(58) Field of Classification Search
CPC ..... H05B 33/0845; H05B 37/0245; H05B 33/0857; H05B 33/0863; H05B 33/0815; H05B 33/0848
USPC ..... 315/291–308
See application file for complete search history.

(56) References Cited

U.S. PATENT DOCUMENTS

| | | | | |
|---|---|---|---|---|
| 6,400,103 | B1 * | 6/2002 | Adamson | H04L 12/2803 315/292 |
| 9,301,359 | B2 | 3/2016 | Wray | |
| 2008/0315798 | A1 * | 12/2008 | Diederiks | H05B 33/0863 315/312 |
| 2012/0133298 | A1 * | 5/2012 | Campbell | H05B 37/0263 315/250 |
| 2013/0063042 | A1 * | 3/2013 | Bora | H05B 33/0863 315/292 |
| 2015/0351190 | A1 * | 12/2015 | Walters | H05B 33/0815 315/186 |
| 2016/0242253 | A1 * | 8/2016 | Bhagwat | H05B 33/0815 |
| 2018/0220505 | A1 * | 8/2018 | Silverman | H05B 33/0869 |

* cited by examiner

*Primary Examiner* — Douglas W Owens
*Assistant Examiner* — Amy X Yang
(74) *Attorney, Agent, or Firm* — St. Onge Steward Johnston & Reens LLC

(57) ABSTRACT

A lighting system and method includes a light module and control module having analog and digital inputs. The control module sends a lighting control output signal to the light module. A mode selector sets a mode of the control module. In a first mode, the lighting control output signal is based on one analog dimming lighting control input signal provided to an analog input. In a second mode, the lighting control output signal is based on dimming and color lighting control input signals provided to two analog inputs. In a third mode, the lighting output control signal is based on a digital lighting control input signal provided to a digital input. In a fourth mode, the control module determines a selected lighting scene based on a scene selection input signal provided to an analog input, and the lighting output signal is based on the selected lighting scene.

20 Claims, 1 Drawing Sheet

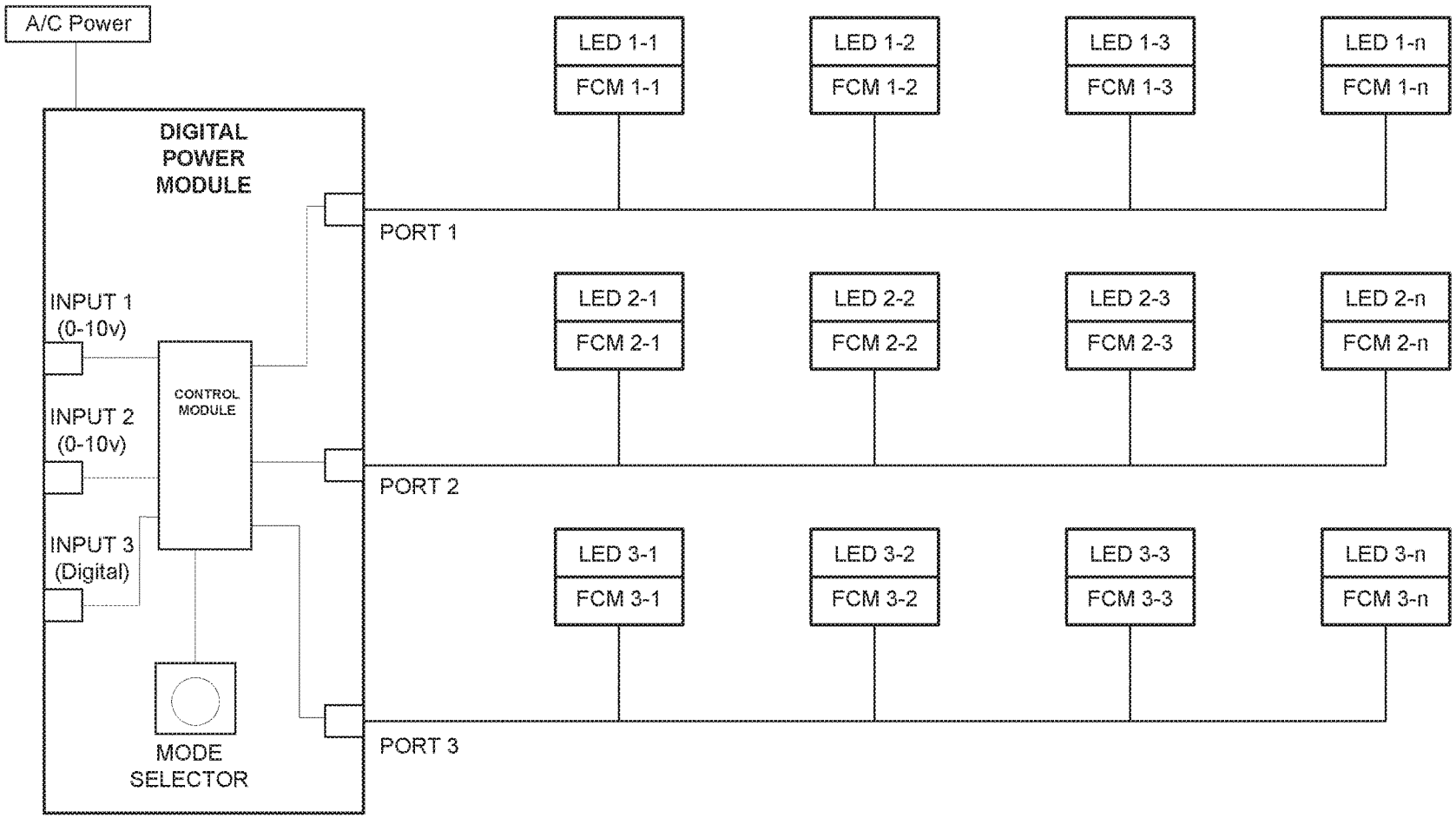
LED 1-n
FCM 1-n
LED 1-3
FCM 1-3
LED 1-2
FCM 1-2
LED 1-1
FCM 1-1
LED 2-n
FCM 2-n
LED 2-3
FCM 2-3
LED 2-2
FCM 2-2
LED 2-1
FCM 2-1
LED 3-n
FCM 3-n
LED 3-3
FCM 3-3
LED 3-2
FCM 3-2
LED 3-1
FCM 3-1
PORT 1
PORT 2
PORT 3
DIGITAL POWER MODULE
CONTROL MODULE
MODE SELECTOR
A/C Power
INPUT 1 (0-10v)
INPUT 2 (0-10v)
INPUT 3 (Digital)

MULTI-MODE LIGHTING SYSTEM AND METHOD

FIELD OF THE INVENTION

The system relates to a lighting system having multiple selectable modes which is particularly suitable for LED lighting systems and other applications.

BRIEF DESCRIPTION OF THE DRAWINGS

FIG. 1 is a block diagram of a multi-mode lighting system.

BACKGROUND OF THE INVENTION

LED lighting has seen increasing use in the past few years. Some of the advantages of LED lighting include reduced power consumption compared to incandescent or even fluorescent lighting, long life of the LED fixtures, precise control, numerous variations in the color of the light emitted by LED fixtures, and reduced size and weight of the fixtures allowing for greater use in various applications.

LED lighting systems are able to be controlled by various types of lighting controls, such as analog controls, such as 0-10 volt controls and/or digital controls, such as Digital Multiplex (DMX).

However, a major disadvantage in known lighting systems is that the lighting systems are configured to receive a certain type of lighting control signal and such systems lack flexibility in changing lighting control modes. Therefore, what is desired is a lighting system and method that can operate in multiple modes to receive various combinations of lighting control signals.

SUMMARY OF THE INVENTION

The lighting system disclosed herein overcomes the drawbacks of prior lighting systems by providing a lighting system having multiple modes of operation each of which is configured to receive and execute various combinations of analog and digital lighting controls, and having means to conveniently switch between the various modes.

In one configuration, a multi-mode lighting system and method is provided comprising a light module and a control module coupled to the light module. The control module is operable to receive a plurality of lighting control input signals and to send at least one lighting control output signal to the light module based on at least one of the lighting control input signals, and the lighting control output signal is operable to control at least one of an intensity and color of light emitted by the light module. The control module has a plurality of inputs including at least two analog inputs each adapted to receive an analog lighting control input signal and at least one digital input adapted to receive a digital lighting control input signal. The lighting system also has a mode selector coupled to the control module, and the mode selector is operable to set the control module into any one of a plurality of modes (e.g., first, second, third and fourth modes).

In a first mode of the control module, the lighting control output signal is based on one analog lighting control input signal provided to one of the two analog inputs, where the one analog lighting control input signal is a dimming control signal to selectively control the intensity of the light emitted by the light module, and the control module is operable to send the lighting control output signal to the light module according to the one analog lighting control input signal.

In a second mode of the control module, the lighting control output signal is based on first and second analog lighting control input signals respectively provided to the two analog inputs, where the first analog lighting control input signal is a dimming control signal to selectively control the intensity of the light emitted by the light module and the second analog lighting control input signal is a color selection signal to selectively control the color of the light emitted by the light module, and the control module is operable to send the lighting control output signal to the light module i according to the first lighting control input signal and the second lighting control input signal.

In a third mode of the control module, the lighting output control signal is based on a digital lighting control input signal provided to the digital input, and the control module is operable to send the lighting control output signal to the light module according to the digital lighting control input signal.

In a fourth mode, the control module is operable to receive a lighting scene selection signal provided to one of the two analog inputs and is operable to determine a selected lighting scene according to the lighting scene selection signal, where the selected lighting scene is determined by an algorithm or is selected from among a plurality of predetermined lighting scenes stored in a memory of the lighting module, and the control module is operable to send the lighting control output signal to the light module according to the selected lighting scene.

Other objects of the invention and its particular features and advantages will become more apparent from consideration of the following drawings and accompanying detailed description.

BRIEF DESCRIPTION OF THE DRAWINGS

FIG. 1 is a schematic drawing of a lighting system in accordance with the invention.

DETAILED DESCRIPTION OF THE INVENTION

Referring to FIG. 1, an embodiment of a multi-mode lighting system according to the invention includes a central Digital Power Module (DPM) for providing power and control to a plurality of distributed LED light fixtures. Multiple LED light fixtures can be connected together in a string, such as in a daisy-chain configuration, and multiple such strings can be connected to the DPM, with each string being connected to a separate port on the DPM. The LED light fixtures can be connected to the DPM by low-voltage wiring carrying both power and control signals for the light fixtures, such as CAT 5/6 wiring. The DPM can receive A/C power (or D/C) from an external power source and can transmit D/C power (or A/C) to the LED light fixtures over the wiring. Each LED light fixture can include a Fixture Control Module (FCM) operable to receive analog and/or digital control signals and operable to drive LEDs (or other SSL) light sources.

The DPM includes a number of control signal input ports for receiving lighting control signals from one or more control signal sources (not shown). For example, the DPM can include 2 input ports for 0-10 volt analog control signals and 1 input port fora digital control signal (e.g., DMX). The DPM includes a Control Module for receiving, processing and/or forwarding the control signals to the LED light fixtures.

The DPM also preferably includes a Mode Selector having a number of discrete positions or settings corresponding to pre-determined operational modes of the DPM. The Mode Selector can be a physical rotary selector switch having discrete angular setting positions. Alternatively, the Mode Selector can be a remotely programmable software switch, or the like, for configuring the Control Module.

Preferably the Mode Selector readily is accessible from an exterior of the DPM such that the position of the Mode Selector can be easily set or adjusted during installation (i.e., in the field). Preferably, the Mode Selector is disposed in an interior of the DPM and is accessible through an access port or opening, or via a removable door or cover. Alternatively, the Mode Selector can be disposed on an exterior of the DPM.

As an example, the Mode Selector can have 5 discrete positions, namely Mode 1, Mode 2, Mode 3, Mode 4 and Mode 5. In one embodiment, the various modes can be as follows:

Mode 1 configures the Control Module to recognize one of the 0-10 volt inputs (e.g., Input 1) as a dimming control signal for single color light fixtures (i.e., light fixture having one channel). The Control Module preferably processes and/or converts the 0-10 volt signal to a digital control signal, such as a DMX signal, and then passes that digital control signal on to the LED light fixtures; however, the Control Module can pass that control signal to the LED light fixtures as an analog dimming control signal without processing or conversion. Alternatively, Mode 1 can configure the Control Module to recognize the digital control input (e.g., Input 3) as a dimming control signal and the Control Module can pass that digital control input on to the LED light fixtures without further processing or conversion, or the Control Module can process and/or convert that digital control signal and then pass the processed/converted signal on to the LED light fixtures.

Mode 2 configures the Control Module to recognize one of the 0-10 volt inputs (e.g., Input 1) as a dimming control signal for light fixtures which change intensity and color (color temperature) in response to a single dimming control signal, for example LED lighting fixtures incorporating the patented Warm Glow® dimming technology of USAI, LLC, as described in U.S. Pat. No. 9,301,359 (incorporated herein by reference). Again, the Control Module preferably processes and/or converts the 0-10 volt signal to a digital control signal, such as a DMX signal, and then passes that digital control signal on to the LED light fixtures; however, the Control Module can pass the control signal to the LED light fixtures as an analog dimming control signal without processing or conversion. Alternatively, Mode 2 can configure the Control Module to recognize the digital control input as a dimming control signal for light fixtures which change intensity and color (color temperature) in response to a single dimming control signal. As described herein, the Control Module can pass that digital control input on to the LED light fixtures without further processing or conversion, or can process and/or convert that digital control signal and then pass the processed/converted signal on to the LED light fixtures.

Mode 3 configures the Control Module to recognize both of the 0-10 volt inputs (e.g., Inputs 1 & 2)—one as a dimming control signal and one as a color control signal—for light fixtures which receive two separate control signals for intensity and color, for example LED lighting fixtures incorporating the patented Color Select® lighting technology of USAI, LLC, as described in U.S. Pat. No. 9,301,359 (incorporated herein by reference). Again, the Control Module preferably processes and/or converts the 0-10 volt signals to one or more digital control signals, such as a DMX signal, and then passes the digital control signal(s) on to the LED light fixtures; however, the Control Module can pass the control signals to the LED light fixtures as an analog dimming control signals without processing or conversion. Alternatively, Mode 3 can configure the Control Module to recognize the digital control input as two separate control inputs—one as a dimming control signal and one as a color control signal—for light fixtures which receive two separate control signals for intensity and color. Again, the Control Module can pass that digital control input on to the LED light fixtures without further processing or conversion, or can process and/or convert that digital control signal and then pass the processed/converted signal on to the LED light fixtures.

Mode 4 configures the Control Module to recognize the digital control input as multiple control inputs for LED light fixtures having multiple color channels (e.g., four color channels for RGBW). As described herein, the Control Module can pass that digital control input on to the LED light fixtures without further processing or conversion, or can process and/or convert that digital control signal and then pass the processed/converted signal on to the LED light fixtures.

Mode 5 configures the Control Module to recognize one of the 0-10 volt inputs (e.g., Input 2) as a scene selection control signal to select between a plurality of predefined scenes (e.g., colors or color temperatures), while the other 0-10 volt input (e.g., input 1) can provide dimming/intensity control. For example, the scene selection input can be used to select between up to 10 predefined scenes, which can be, for example, predefined colors (for an RGBW light fixture) or predefined color temperatures (for a tunable white fixture), or other predefined scenes for these or other types of light fixtures. In this mode, the voltage level of the input is used as an indicator of the desired selection. The voltage level is converted to a digital signal by an A/D converter in the microprocessor in the DPM. The processor uses the converted signal level to obtain color channel intensity values for a plurality of color channels (e.g., 2-4 color channels). The color channel intensity values can be obtained by one or more predefined algorithms, or can be obtained by performing a look up in a table in the DPM which stores color channel intensity levels for each predefined scene. Once the color channel intensity levels are obtained, the DPM transmits the color channel intensity levels to the FCMs, for example via a digital DMX signal.

The A/D converter can produce about 200 signal levels from a 0-10 v input signal. Thus, as an example, where the table stores information for 10 predefined scenes, the various scenes can be evenly weighted/distributed within the table such that each scene can correspond to an equal range of about 20 signal levels. Dimmers can be linear or non-linear To compensate for (non-linear) logarithmic dimmers (where the signal changes slower at deeper dimming levels and faster at the brighter end), the entries in the lookup table can be arranged such that scene selection is linear (or approximately so) with respect to the dimmer position. This can be accomplished by using a weighted distribution of the various scenes in the table, For example, going from the lower end of the dimmer to the upper end, the various scenes can correspond to increasing ranges of signal levels, where the variation in ranges can be approximately logarithmic. As can be appreciated, other dimmers with other types of non-linear dimming curves are possible, but it is preferable that the weightings in the table correspond at least approximately to the dimming curve of the dimmer.

The mode can include a hysteresis function so that the scene selection is stable and so that scene selections are positive and do not glitch back and forth, even if the 0-10 v input signal fluctuates.

As can be appreciated, the scene selection functionality of the DPM in Mode 5 can be incorporated in a single mode DPM and/or light fixture.

While the certain embodiments described herein pertain to a distributed lighting system having a central power and control module (DPM) and distributed (remotely located) LED light fixtures, the invention is also applicable for self-contained lighting fixtures (wherein components are disposed within a single housing) which receive control signals directly from one or more control units. In such cases the features and functions of the DPM described herein can be incorporated into each LED light fixture. In particular, each LED light fixture includes multiple input ports such as described herein, as well as a Control Module and Mode Selector operable to configure the Control Module in the manner described herein.

In one configuration, the multi-mode lighting system and method includes a light module (which can include a lighting element (e.g., an LED or SSD lighting element, or another type) and a Fixture Control Module (FCM) and/or a lighting driver) and includes a control module (e.g., DPM) coupled to the light module. The control module is operable to receive a plurality of lighting control input signals and to send at least one lighting control output signal to the light module based on at least one of the lighting control input signals, and the lighting control output signal is operable to control at least one of an intensity and color of light emitted by the light module. The lighting control output signal can consist of or comprises a digital signal.

The control module has a plurality of inputs including at least two analog inputs each adapted to receive an analog lighting control input signal and at least one digital input adapted to receive a digital lighting control input signal. The lighting system also has a mode selector coupled to the control module, and the mode selector is operable to set the control module into any one of a plurality of modes (e.g., first, second, third and fourth modes).

In a first mode of the control module, the lighting control output signal is based on one analog lighting control input signal provided to one of the two analog inputs, where the one analog lighting control input signal is a dimming control signal to selectively control the intensity of the light emitted by the light module, and the control module is operable to send the lighting control output signal to the light module according to the one analog lighting control input signal.

In a second mode of the control module, the lighting control output signal is based on first and second analog lighting control input signals respectively provided to the two analog inputs, where the first analog lighting control input signal is a dimming control signal to selectively control the intensity of the light emitted by the light module and the second analog lighting control input signal is a color selection signal to selectively control the color of the light emitted by the light module, and the control module is operable to send the lighting control output signal to the light module i according to the first lighting control input signal and the second lighting control input signal.

In a third mode of the control module, the lighting output control signal is based on a digital lighting control input signal provided to the digital input, and the control module is operable to send the lighting control output signal to the light module according to the digital lighting control input signal.

In a fourth mode, the control module is operable to receive a lighting scene selection signal provided to one of the two analog inputs and is operable to determine a selected lighting scene according to the lighting scene selection signal, where the selected lighting scene is determined by an algorithm or is selected from among a plurality of predetermined lighting scenes stored in a memory of the lighting module, and the control module is operable to send the lighting control output signal to the light module according to the selected lighting scene.

In one configuration, in the first mode, the lighting control output signal is based solely on the one analog lighting control input signal, in the second mode, the lighting control output signal is based only on the first and second analog lighting control input signals, in the third mode, the lighting control output signal is based solely on the digital lighting control input signal; and/or in the fourth mode, the control module is operable to determine the selected lighting scene according to only the lighting scene selection signal.

In one configuration, in the fourth mode, the control module is operable to receive the lighting scene selection signal from a dimmer wherein scene selection corresponds to a position of the dimmer and where the dimmer generates a non-linear signal with respect to a position of the dimmer. The control module is operable to compensate for the non-linear signal so that scene selection is at least approximately linear with respect to the position of the dimmer. Thus, the rate of change of scene selection corresponds to or is substantially equal to the rate of change of position of the dimmer.

The control module is operable to convert the lighting scene selection signal into a digital value and the digital value is used to select the selected lighting scene from the predetermined lighting scenes, and a distribution of the predetermined lighting scenes in the memory is weighted according to a dimming curve of the non-linear signal generated by the dimmer so that scene selection is at least approximately linear with respect to the position of the dimmer. Each of the predetermined lighting scenes can correspond to a different or unique combination of at least color and intensity of the light emitted by the light module. The control module can employ a hysteresis function to stabilize the determination of the selected lighting scene.

In another configuration, a method In one configuration, the multi-mode lighting system includes a light module (which can include a lighting element (e.g., an LED or SSD lighting element, or another type) and a Fixture Control Module (FCM) and/or a lighting driver) and includes a control module (e.g., DPM) coupled to the light module. The control module is operable to receive a plurality of lighting control input signals and to send at least one lighting control output signal to the light module based on at least one of the lighting control input signals, and the lighting control output signal is operable to control at least one of an intensity and color of light emitted by the light module. The lighting control output signal can consist of or comprises a digital signal.

The control module has a plurality of inputs including at least two analog inputs each adapted to receive an analog lighting control input signal and at least one digital input adapted to receive a digital lighting control input signal. The lighting system also has a mode selector coupled to the control module, and the mode selector is operable to set the control module into any one of a plurality of modes (e.g., first, second, third and fourth modes).

In a first mode of the control module, the lighting control output signal is based on one analog lighting control input signal provided to one of the two analog inputs, where the one analog lighting control input signal is a dimming control signal to selectively control the intensity of the light emitted by the light module, and the control module is operable to send the lighting control output signal to the light module according to the one analog lighting control input signal.

In a second mode of the control module, the lighting control output signal is based on first and second analog lighting control input signals respectively provided to the two analog inputs, where the first analog lighting control input signal is a dimming control signal to selectively control the intensity of the light emitted by the light module and the second analog lighting control input signal is a color selection signal to selectively control the color of the light emitted by the light module, and the control module is operable to send the lighting control output signal to the light module i according to the first lighting control input signal and the second lighting control input signal.

In a third mode of the control module, the lighting output control signal is based on a digital lighting control input signal provided to the digital input, and the control module is operable to send the lighting control output signal to the light module according to the digital lighting control input signal.

In a fourth mode, the control module is operable to receive a lighting scene selection signal provided to one of the two analog inputs and is operable to determine a selected lighting scene according to the lighting scene selection signal, where the selected lighting scene is determined by an algorithm or is selected from among a plurality of predetermined lighting scenes stored in a memory of the lighting module, and the control module is operable to send the lighting control output signal to the light module according to the selected lighting scene.

Although the invention has been described with reference to a particular arrangement of parts, features and the like, these are not intended to exhaust all possible arrangements or features, and indeed many other modifications and variations will be ascertainable to those of skill in the art.

What is claimed:

1. A multi-mode lighting system comprising:

a light module;

a control module coupled to the light module via a first pair of wires adapted to transmit power to said light module and a second pair of wires adapted to transmit control signals to said light module, the control module being operable to receive a plurality of lighting control input signals and to send at least one lighting control output signal via the second pair of wires to the light module based on at least one of the lighting control input signals, and the lighting control output signal being operable to control at least one of an intensity and color of light emitted by the light module;

the control module having a plurality of inputs including at least two analog inputs each adapted to receive an analog lighting control input signal and at least one digital input adapted to receive a digital lighting control input signal;

a mode selector coupled to the control module, the mode selector being operable to set the control module into any one of at least first, second, third and fourth modes;

wherein in the first mode of the control module the lighting control output signal is based on one analog lighting control input signal provided to one of the two analog inputs where the one analog lighting control input signal is a dimming control signal to selectively control the intensity of the light emitted by the light module, and the control module is operable to send the lighting control output signal to the light module according to the one analog lighting control input signal;

wherein in the second mode of the control module the lighting control output signal is based on first and second analog lighting control input signals respectively provided to the two analog inputs where the first analog lighting control input signal is a dimming control signal to selectively control the intensity of the light emitted by the light module and the second analog lighting control input signal is a color selection signal to selectively control the color of the light emitted by the light module, and the control module is operable to send the lighting control output signal to the light module according to the first lighting control input signal and the second lighting control input signal;

wherein in the third mode of the control module the lighting output control signal is based on a digital lighting control input signal provided to the digital input, and the control module is operable to send the lighting control output signal to the light module according to the digital lighting control input signal; and wherein in the fourth mode the control module is operable to receive a lighting scene selection signal provided to one of the two analog inputs and is operable to determine a selected lighting scene according to the lighting scene selection signal, where the selected lighting scene is determined by an algorithm or is selected from among a plurality of predetermined lighting scenes stored in a memory of the lighting module, and the control module is operable to send the lighting control output signal to the light module according to the selected lighting scene.

2. The multi-mode lighting system of claim 1, wherein, in the fourth mode:

the control module is operable to receive the lighting scene selection signal from a dimmer which generates a non-linear signal with respect to a position of the dimmer; and the control module is operable to compensate for the non-linear signal so that scene selection is at least approximately linear with respect to the position of the dimmer.

3. The multi-mode lighting system of claim 2, wherein, in the fourth mode:

the control module is operable to convert the lighting scene selection signal into a digital value and the digital value is used to select the selected lighting scene from the predetermined lighting scenes; and a distribution of the predetermined lighting scenes in the memory is weighted according to a dimming curve of the non-linear signal generated by the dimmer so that scene selection is at least approximately linear with respect to the position of the dimmer.

4. The multi-mode lighting system of claim 1, wherein, in the fourth mode:

the control module employs a hysteresis function to stabilize the determination of the selected lighting scene.

5. The multi-mode lighting system of claim 1, wherein the light module is located remotely from the control module.

6. The multi-mode lighting system of claim 1, wherein:

in the first mode, the lighting control output signal is based solely on the one analog lighting control input signal;

in the second mode, the lighting control output signal is based only on the first and second analog lighting control input signals;

in the third mode, the lighting control output signal is based solely on the digital lighting control input signal; and in the fourth mode, the control module is operable to determine the selected lighting scene according to only the lighting scene selection signal.

7. The multi-mode lighting system of claim 1, wherein the light module and control module are disposed in a single housing.

8. The multi-mode lighting system of claim 1, wherein, in the fourth mode: each of the predetermined lighting scenes corresponds to a different combination of at least color and intensity of the light emitted by the light module.

9. The multi-mode lighting system of claim 1, wherein, in the first mode: the lighting control output signal comprises a digital signal.

10. The multi-mode lighting system of claim 1, wherein, in the second mode: the lighting control output signal comprises a digital signal.

11. The multi-mode lighting system of claim 1, wherein, in the third mode: the lighting control output signal comprises a digital signal.

12. The multi-mode lighting system of claim 1, wherein, in the fourth mode: the lighting control output signal comprises a digital signal.

13. The multi-mode lighting system of claim 1, wherein, in the first, second, third and fourth modes: the lighting control output signal comprises a digital signal.

14. The multi-mode lighting system of claim 1, wherein the two analog inputs are each adapted to receive 0-10 volt analog signals.

15. The multi-mode lighting system of claim 1, wherein, in the fourth mode the control module is operable to receive the lighting scene selection signal from a dimmer wherein scene selection corresponds to a position of the dimmer.

16. The multi-mode lighting system of claim 1, wherein, in the first mode the control module sends a digital signal to the light source to control the intensity of the light source;

in the second mode the control module sends a digital signal to the light source to control the intensity and the color of the light source;

in the third mode the control module sends a digital signal to the light source to control the light source; and in the fourth mode the control module sends a digital signal to the light source to control the light source based on the selected lighting scene.

17. A multi-mode lighting system comprising:

a control module operable to receive a plurality of input signals, the control module having at least three inputs each adapted to receive a lighting control signal;

a light source coupled to the control module via a first pair of wires adapted to transmit power to said light source and a second pair of wires adapted to transmit control signals to said light source;

a mode selector coupled to the control module, the mode selector being operable to set the lighting system into any one of a plurality of lighting modes;

wherein in a first mode the control module functions based solely on one analog lighting control signal provided to one of the at least three inputs where the one analog lighting control signal is a dimming control signal to selectively control an intensity of the light source, and the control module controlling an intensity of the light source according to the one analog lighting control signal;

wherein in a second mode the control module functions based solely on a first analog input signal provided to one of the at least three inputs and a second analog input signal provided to a second of the at least three inputs, the first analog input signal is a dimming control signal to selectively control an intensity of the light source and the second analog input signal is a color selection signal to selectively control a color of the light source, and the control module controlling an intensity and a color of the light source based on the first and second analog input signals;

wherein in a third mode the control module functions based solely on a digital input signal provided to one of the at least three inputs, and the control module controlling the light source according to the digital input signal; and wherein in a fourth mode the control module functions based solely on a lighting control signal provided to one of the at least three inputs, where the lighting control signal received is a lighting scene selection signal, and the control module is operable to determine a lighting scene according to the received lighting scene selection signal, where a selected lighting scene is determined by an algorithm or is selected from among a plurality of predetermined lighting scenes stored in a memory of the lighting system and where each of the predetermined lighting scenes corresponds to a combination of at least color and intensity of the light source, and the control module controlling the light source according to the selected lighting scene.

18. The multi-mode lighting system of claim 17, wherein, in the first mode the control module sends a digital signal to the light source to control the intensity of the light source;

in the second mode the control module sends a digital signal to the light source to control the intensity and the color of the light source;

in the third mode the control module sends a digital signal to the light source to control the light source; and in the fourth mode the control module sends a digital signal to the light source to control the light source based on the selected lighting scene.

19. A method of comprising:

providing a light module;

providing a control module coupled to the light module via a first pair of wires adapted to transmit power to the light module and a second pair of wires adapted to transmit control signals to the light module, the control module being operable to receive a plurality of lighting control input signals and to send at least one lighting control output signal via the second pair of wires to the light module based on at least one of the lighting control input signals, and the lighting control output signal being operable to control at least one of an intensity and color of light emitted by the light module;

the control module having a plurality of inputs including at least two analog inputs each adapted to receive an analog lighting control input signal and at least one digital input adapted to receive a digital lighting control input signal;

providing a mode selector coupled to the control module, the mode selector being operable to set the control module into any one of at least first, second, third and fourth modes;

operating to the mode selector to set the control module to one the first, second, third or fourth modes;

wherein in a first mode of the control module the lighting control output signal is based on one analog lighting control input signal provided to one of the two analog inputs where the one analog lighting control input signal is a dimming control signal to selectively control the intensity of the light emitted by the light module, and the control module is operable to send the lighting control output signal to the light module according to the one analog lighting control input signal;

wherein in a second mode of the control module the lighting control output signal is based on first and second analog lighting control input signals respectively provided to the two analog inputs where the first analog lighting control input signal is a dimming control signal to selectively control the intensity of the light emitted by the light module and the second analog lighting control input signal is a color selection signal to selectively control the color of the light emitted by the light module, and the control module is operable to send the lighting control output signal to the light module i according to the first lighting control input signal and the second lighting control input signal;

wherein in a third mode of the control module the lighting output control signal is based on a digital lighting control input signal provided to the digital input, and the control module is operable to send the lighting control output signal to the light module according to the digital lighting control input signal; and wherein in a fourth mode the control module is operable to receive a lighting scene selection signal provided to one of the two analog inputs and is operable to determine a selected lighting scene according to the lighting scene selection signal, where the selected lighting scene is determined by an algorithm or is selected from among a plurality of predetermined lighting scenes stored in a memory of the lighting module, and the control module is operable to send the lighting control output signal to the light module according to the selected lighting scene.

20. The method claim 19, wherein in the fourth mode:

the control module is operable to receive the lighting scene selection signal from a dimmer which generates a non-linear signal with respect to a position of the dimmer; and the control module is operable to compensate for the non-linear signal so that scene selection is at least approximately linear with respect to the position of the dimmer.

* * * * *